US006759972B2

(12) United States Patent
Gupta et al.

(10) Patent No.: US 6,759,972 B2
(45) Date of Patent: Jul. 6, 2004

(54) TOUR GROUP NOTIFICATION METHOD

(75) Inventors: Om P. Gupta, Ithaca, NY (US); James Elkins, Burdett, NY (US)

(73) Assignee: Digicomp Research Corporation

( * ) Notice: Subject to any disclaimer, the term of this patent is extended or adjusted under 35 U.S.C. 154(b) by 0 days.

(21) Appl. No.: 09/995,129

(22) Filed: Nov. 27, 2001

(65) Prior Publication Data

US 2003/0098794 A1 May 29, 2003

(51) Int. Cl.[7] ..... G08G 1/123

(52) U.S. Cl. ..... 340/994; 340/573.4; 340/991; 340/992; 340/993; 340/989; 340/988; 340/3.52; 340/7.26; 340/7.46; 379/58; 379/59; 364/436

(58) Field of Search ..... 340/573.4, 994, 340/991, 992, 993, 989, 988, 3.52, 7.26, 7.46; 379/58, 59; 364/436

(56) References Cited

U.S. PATENT DOCUMENTS

| | | | | | |
|---|---|---|---|---|---|
| 4,290,143 | A | * | 9/1981 | Wissel et al. | 340/7.44 |
| 4,325,057 | A | | 4/1982 | Bishop | 340/539 |
| 5,021,780 | A | | 6/1991 | Fabiano et al. | 340/994 |
| 5,144,301 | A | | 9/1992 | Jackson et al. | 340/994 |
| 5,400,020 | A | | 3/1995 | Jones et al. | 340/994 |
| 5,483,234 | A | * | 1/1996 | Carreel et al. | 340/994 |
| 5,736,940 | A | * | 4/1998 | Burgener | 340/994 |
| 6,006,159 | A | | 12/1999 | Schmier et al. | 701/200 |
| 6,097,106 | A | | 8/2000 | Roddy et al. | 307/10.5 |
| 6,097,317 | A | | 8/2000 | Lewiner et al. | 340/994 |
| 6,127,917 | A | | 10/2000 | Tuttle | 340/10.1 |
| 6,127,922 | A | | 10/2000 | Roddy et al. | 340/426 |
| 6,308,160 | B1 | * | 10/2001 | Rex | 705/6 |
| 6,529,131 | B2 | * | 3/2003 | Wentworth | 340/573.1 |
| 6,542,751 | B1 | * | 4/2003 | Blink et al. | 455/458 |
| 6,573,824 | B1 | * | 6/2003 | Lovegreen et al. | 340/7.1 |
| 6,603,397 | B2 | * | 8/2003 | Bronson | 340/540 |

* cited by examiner

*Primary Examiner*—Daniel Wu
*Assistant Examiner*—Tai T. Nguyen
(74) *Attorney, Agent, or Firm*—Brown & Michaels, PC

(57) ABSTRACT

The invention is a method of calling a group of tourists back to their conveyance, in which each passenger is given a portable alerting device when they leave the conveyance. When the conveyance is ready to leave, a transmitter on the conveyance transmits a wireless signal which causes the alerting device to vibrate or give off a light or sound signal, alerting the passenger to return to the conveyance for departure.

12 Claims, 1 Drawing Sheet

TOUR GROUP NOTIFICATION METHOD

FIELD OF THE INVENTION

The invention pertains to the field of methods of alerting groups. More particularly, the invention pertains to methods of organizing tour groups and the like by providing warning to passengers of the departure of a conveyance.

BACKGROUND OF THE INVENTION

Group touring is a common method of vacationing. In such tours, a large group of people who usually don't know each other previously travel from point to point by a vehicle—a bus, train, or boat, typically—stopping frequently for short visits to points of interest. Often, the tour company plans only a minimal time at each stop, and either has to waste time tracking down missing passengers, or risk leaving them behind if the group conveyance leaves on time. The problem is exacerbated when the tour group is made up of tourists from various countries, who might not speak the local language and thus would not respond to a public announcement, even if such were possible.

There have been a number of patents issued on systems for communications with passengers about public conveyances.

Bishop, "School Bus Approach Notification Method and Apparatus", U.S. Pat. No. 4,325,057, is a method of warning school children of the impending arrival of their school bus. Each school bus is equipped with a continuously running transmitter on a specific frequency, and the home of each student on a route has a receiver tuned to the frequency used by his/her bus route. The sensitivity of the receiver can be adjusted to determine how far in advance of the bus the alarm is triggered.

Fabiano, et al, "Bus Passenger Alerting System", U.S. Pat. No. 5,021,780, is another school bus alerting system. Like Bishop, Fabiano's system uses continuously transmitted signals from the buses which are picked up by receivers in the students' homes. Instead of a selective frequency, Fabiano uses a digital code identifying the bus route.

Jackson, et al, "School Bus Locator System", U.S. Pat. No. 5,144,301, is another simple receiver picking up a continuously transmitted signal from the bus, with an added feature that a first alarm begins when the bus is a great distance away, and a second alarm is set off as the signal exceeds a given strength.

Jones, et al, "Advance Notification System and Method", U.S. Pat. No. 5,400,020, is also for notification of school bus arrival. In this system, the bus keeps track of its position by GPS, and if it is running behind schedule, notifies a base station by radio. The base station then automatically places telephone calls to the students' homes.

Schmier, et al, "Public Transit Vehicle Arrival Information System", U.S. Pat. No. 6,006,159, also uses GPS receivers on buses to determine their position. The information on bus locations is relayed to a central processor, which broadcasts information on bus location and loading throughout the area served by the bus system. Portable receivers can be programmed to pick up information about a specific bus route and stop.

Lewiner, et al, "Portable Appliance for Informing the Users of a Bus Network About Waiting Times at Stops in the Network", U.S. Pat. No. 6,097,317, also uses a central processor which receives broadcasts from buses and transmits broadcasts of bus positions, to be picked up by a portable receiver programmed with a specific bus route and stop. The portable receiver can then notify a passenger of when to expect the bus at his stop.

Roddy, et al, "Vehicle Security System with Local Area Pager and Anti-Drive Away Protection", U.S. Pat. No. 6,097,106, and "Vehicle Security System with Remote Systems Control", U.S. Pat. No. 6,127,922, are car alarm systems which use vehicle-mounted transmitters to send alerts to pagers in the event of a break-in.

Tuttle, "System and Method for Locating Individuals and Equipment, Airline Reservation System, Communication System", U.S. Pat. No. 6,127,917, is a system for locating airline passengers in a terminal. Each passenger is given an individual wireless transponder, and the airline facility is equipped with a plurality of selectively addressable antennas, so that when a specific passenger is needed, the airline can determine where in the airport he/she is.

Group paging over wide areas is known to the art, as has been used for many years in volunteer fire department call-up systems using a group of pagers having a common alert tone or digital code. Restaurants such as the Outback Steak House chain often use "silent" vibrating paging wands to call waiting customers when their tables are ready.

SUMMARY OF THE INVENTION

The invention is a method of calling a group of tourists back to their conveyance, in which each passenger is given a portable alerting device when they leave the conveyance. When the conveyance is ready to leave, or at one or more times at intervals before departure, a transmitter on the conveyance transmits a wireless signal which causes the alerting device to vibrate or give off a light or sound signal, alerting the passenger to return to the conveyance for departure.

The invention benefits the passengers by making sure they won't miss the bus, and the tour company by not losing passengers. Also, passengers can be allowed to stay and shop longer, making more money for merchants (and possibly the tour company), since they can be recalled through the invention without having to allow a great deal of time to reassemble at the bus.

DESCRIPTION OF THE PREFERRED EMBODIMENT

Figure 1:
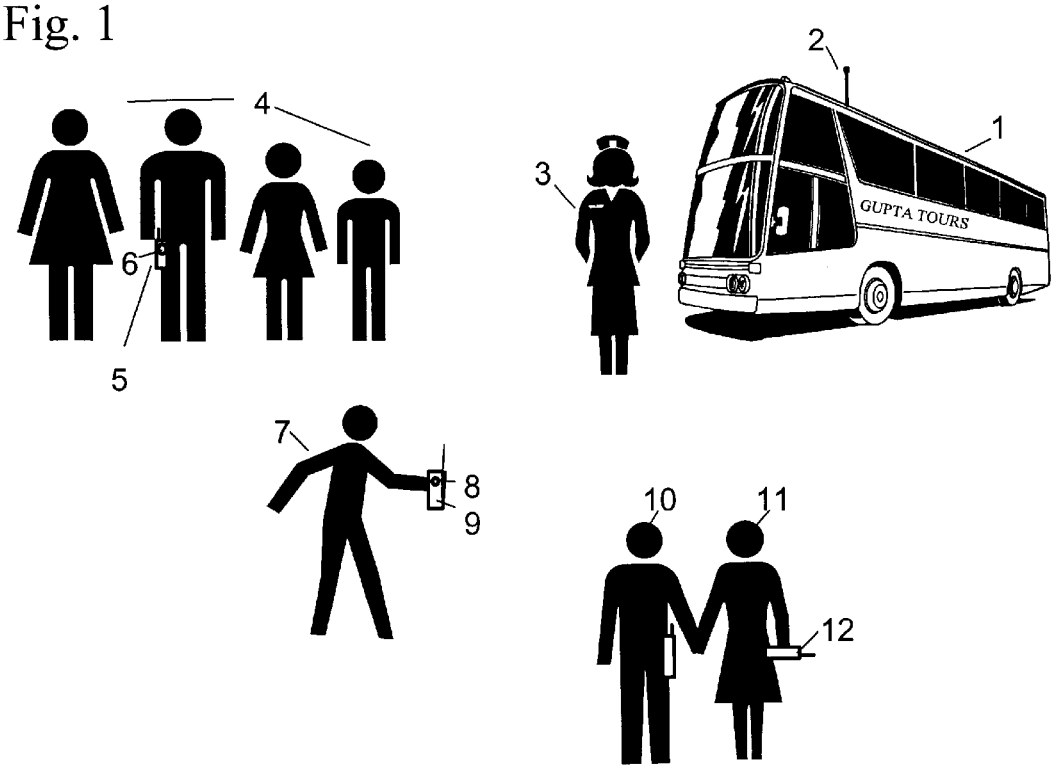
FIG. 1 shows a block diagram of the hardware used by the method of the invention.

Referring to FIG. 1, in the method of the invention a tour group conveyance, here shown as bus (1), is equipped with a wireless transmitter (2) and a number of portable alerting devices (6)(9)(12). When the passengers leave the bus (1), the alerting devices are distributed, either to individual passengers (7)/(9), or to groups (4)/(5). If desired, each passenger in groups (10)(11) can each receive their own alert device (12) to hang on a belt (10) or carry (11).

The wireless transmitter is preferably a radio transmitter having the capability of selectively activating the alerting devices when the tour guide (3) or bus driver activates the transmitter. In the simplest form, this could be just a transmission of an RF carrier on a given frequency, but that would cause problems in the likely case that there might be more than one bus at a given attraction at the same time.

Preferably, the transmitter transmits a selective transmission for summoning just the group for that bus. This selective transmission can be in any of the paging methods known to the art—simple audio tones or tone sequences, digital address data via frequency shift keying (FSK) or audio frequency shift keying (AFSK), subaudible carrier (PL) or digital coded squelch (DCS), or any other method known to the art. The portable alerting devices are designed to receive the signal transmitted by the transmitter, and to decode the selective transmission to determine if the transmission is intended for the group.

If the portable alerting device decodes a transmission as being for its group, it will then alert the person to return to the bus before it leaves. The alert can be in the form of a sound emitted by a speaker or sound device such as a piezoelectric module (6), a light (8) or a vibrator (12), as is known in the pager art. Optionally, the portable alerting device could include a numeric or alphanumeric display which can show a message transmitted from the bus or generated internally in response to a command transmitted from the bus. For example, the transmission from the bus could indicate the time remaining to departure, and the alerting device readout could then count down as the time passes.

The portable alerting device could also be set up with an individual address in addition to the group paging address. This would allow individuals, or sub-groups, to be separately summoned, either because of an emergency or because the individual has proven to be habitually late in returning.

Figure 2:
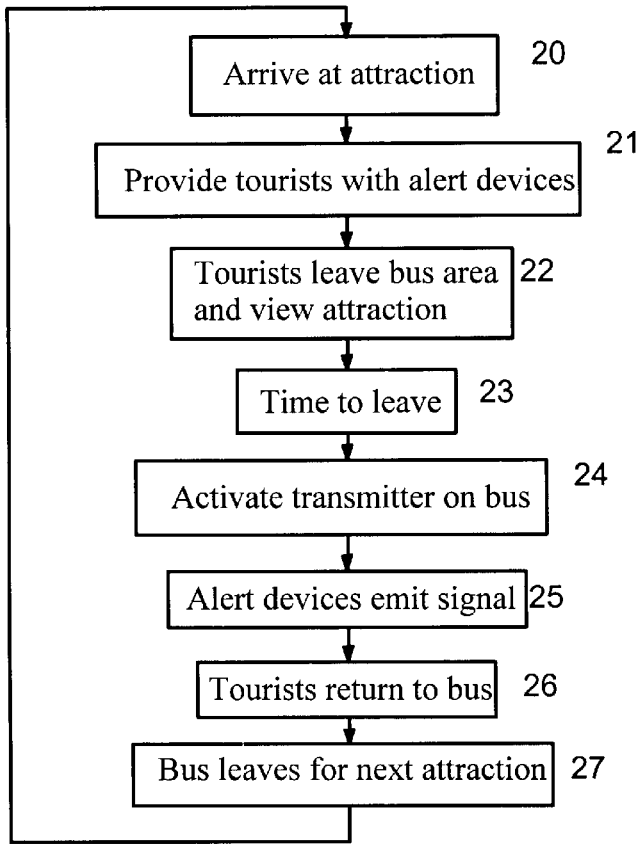
FIG. 2 shows a flowchart of the method of the invention.

FIG. 2 is a flowchart of the method of the invention, which operates as follows:

20. The bus arrives at an attraction. It will be understood that while this invention has been described in terms of "buses," in fact the method will work as well in any tour group conveyance which makes stops at attractions, such as a tour boat or cruise ship, railroad car, car or trolley, etc.
21. As the tourists leave the bus, each tourist or small group of tourists is given an alerting device. It will be understood that in some cases the entire group might be detained in the area of the bus for a while, for example for an introductory lecture or film, in which case the alerting devices might be distributed when the group breaks up after the introduction. In other situations, the devices could be distributed at the beginning of the tour, and retained by the passengers throughout the tour, in which case this step might precede or be simultaneous with step 20.
22. The tourists leave the bus area, and disperse to view the attraction.
23. The time to leave approaches, and
24. The wireless transmitter on the bus is activated. This might be done manually by the tour guide or bus driver, or by a timer set when the bus arrived. Note that the transmitter on the bus could directly activate the alerting devices, or, if required for reasons of terrain or transmitter range, one or more repeater, translator or remote transmitter stations could be provided at locations around the attraction and the signal from the wireless transmitter on the bus could thus be carried to the alerting devices by other transmitters.
25. The portable alerting devices receive the signal from the wireless transmitter, and emit the recall signal (light, sound, vibration, numeric or alpha display).
26. The tourists return to the bus, and
27. The bus leaves, to re-start the method again at the next attraction.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A method of alerting passengers of a tour conveyance of an upcoming departure of the conveyance from a tour stop comprising the steps of:

a) prior to departure from an area around the conveyance, providing a plurality of passengers with a plurality of portable wireless alerting devices, one alerting device for each passenger or group of passengers;

b) at a selected time prior to departure of the conveyance, transmitting a wireless signal from a transmitter on the conveyance, causing all of the plurality of the portable wireless alerting devices to emit an alert signal, such that the passengers of the tour conveyance are warned of an upcoming departure of the conveyance.

2. The method of claim 1, in which the wireless alerting device is a radio receiver, and the transmitter is a radio transmitter.

3. The meth of claim 2, in which the wireless signal contains information addressed to the plurality of wireless alerting devices associated with a particular tour conveyance.

4. The method of claim 1, in which at least one of the plurality of wireless alerting devices can be individually addressed, the wireless signal contains information addressed to the individually addressed wireless alerting device and step b is performed to recall the individually addressed wireless alerting device at a selected time separate from the selected time for the plurality of wireless alerting devices.

5. The method of claim 1, in which the alert signal is a vibration.

6. The method of claim 1 in which the alert signal is a light.

7. The method of claim 4, in which the alert signal is a sound.

8. The method of claim 1 in which the alert signal is an alphanumeric message.

9. The method of claim 8 in which the message is a count-down time to departure.

10. The method of claim 1, in which the selected time is determined manually by manually activating the transmitter.

11. The method of claim 1, in which the selected time is automatically set by a timer.

12. The method of claim 1, in which step b is repeated for multiple selected times prior to departure.

* * * * *